US005722783A

United States Patent [19]

Kiyomi

[11] Patent Number: 5,722,783

[45] Date of Patent: Mar. 3, 1998

[54] FILE FOLDER

[75] Inventor: Takio Kiyomi, Kyoto, Japan

[73] Assignee: Kokuyo Co., Ltd., Osaka, Japan

[21] Appl. No.: 553,325

[22] PCT Filed: Apr. 3, 1995

[86] PCT No.: PCT/JP95/00651

§ 371 Date: May 14, 1996

§ 102(e) Date: May 14, 1996

[87] PCT Pub. No.: WO96/04144

PCT Pub. Date: Feb. 15, 1996

[30] Foreign Application Priority Data

Aug. 4, 1994 [JP] Japan ..... 6-183548

[51] Int. Cl.[6] ..... B42F 13/12

[52] U.S. Cl. ..... 402/70; 402/75; 402/54; 402/60; 281/29

[58] Field of Search ..... 402/48, 52, 53, 402/54, 2, 70–78, 60; 281/21.1, 22, 24, 27.3, 28, 29, 35–37

[56] References Cited

U.S. PATENT DOCUMENTS

| | | | |
|---|---|---|---|
| 1,763,075 | 6/1930 | Unger | 402/2 X |
| 1,905,437 | 4/1933 | Buchan | 402/48 |
| 2,083,434 | 6/1937 | Crump | 281/27.3 |
| 2,791,220 | 5/1957 | McBee | 402/75 X |
| 3,958,886 | 5/1976 | Price | 402/75 |
| 4,314,716 | 2/1982 | Errichiello | 281/29 |
| 4,750,884 | 6/1988 | Bourgeois et al. | 402/75 |
| 5,375,883 | 12/1994 | Wyant | 281/37 |

FOREIGN PATENT DOCUMENTS

| | | | |
|---|---|---|---|
| 2376756 | 9/1978 | France | 402/52 |
| 62-73977 | 5/1987 | Japan . | |
| 1-116688 | 8/1989 | Japan . | |
| 2-135278 | 11/1990 | Japan . | |
| 4-45783 | 4/1992 | Japan . | |
| 1057457 | 2/1967 | United Kingdom | 402/75 |

*Primary Examiner*—A. L. Pitts
*Assistant Examiner*—Julie A. Krolikowski
*Attorney, Agent, or Firm*—Banner & Witcoff,Ltd.

[57] ABSTRACT

A file folder is provided which includes a pair of foldable front and rear covers 4 and 5, a back cover 6 integrally located between and connected to them via hinge sections 7, and a binding fastener 3 fixedly attached on the inner face of the back cover. An engaging projection 8 is formed on the inner face of at least one of the front and rear covers 4 and 5 for abutting engagement with the binding fastener when the file folder is closed. With this arrangement, the file folder having a plurality of loose papers bound together along their longer edges by the fastener 3 can be kept standing with its back cover 6 positioned above and horizontally oriented without causing the back cover 6 and hinge sections 7 to be distorted.

4 Claims, 5 Drawing Sheets

FILE FOLDER

FIELD OF THE ART

This invention relates generally to paper file folders and, more particularly, to file folders of the type suitable for storage in such a manner that the loose papers secured within the folder are suspended vertically downward.

PRIOR ART

Various types of file folders are conventionally known. These prior-art folders are generally made of flat and rigid sheet material such as cardboard and synthetic plastics, and includes a pair of front and rear covers which are integrally connected with a back cover via fold lines or hinge sections. A binding fastener is fixedly attached to the inner face of the back cover as by bonding, welding or riveting.

A typical prior-art file folder includes a pair of front and rear covers having a longitudinal length longer than the lateral width and is designed to bind or secure a plurality of loose papers along their longer edges by a binding fastener. This type of paper binding will hereinafter be referred to as the "S-binding". In the conventional practice, the file folder with S-bound papers is usually kept or otherwise stored upright on a bookshelf or in a cabinet with the back cover to which the fastener is fixed standing upright in a vertical direction. This manner of storing will hereinafter be referred to as the "S-type storage.

Meanwhile, it is of late attempted for the purpose of efficient use of a limited space to place such file folders on a support shelf in such a position that the back cover is kept above and extends horizontally, with the loose papers that are S-bound within the file folder being suspended vertically from its binding fastener. This manner of storing will hereinafter be referred to as the "E-type storage.

However, when the S-binding file folder is kept in the E-type storage mode, the back cover tends to be bent downward and the hinge sections to be disfigured by the weight of the S-bound papers. More precisely, in a file folder deigned to secure a large number of loose papers, the back cover of the folder naturally has an extended width for accommodating them. With the paper fastener being securely fixed as by rivets in the central portion of the back cover, the whole weight of the S-bound papers concentrates on that central portion of the back cover, causing it to warp downward. In addition, the longitudinally extending hinge sections that foldably join both the front and rear covers to the back cover is less rigid than the rest of the folder. In the event that all of the covers are to be integrally formed of suitable synthetic plastic material, the two hinge sections are ordinarily made much thinner than the rest in order to facilitate folding of the front and rear covers. As the weight of the bound papers acts on the back cover,-the thin hinge sections are placed under a heavy stress, resulting in their excessive distortion as well as their reduced durability or shortened lifetime.

SUMMARY OF THE INVENTION

It is an object of the invention to provide a new and improved file folder free from these and other problems inherent in the prior-art file folders.

In order to realize this object, a new arrangement is provided for the file folder. The file folder according to claim 1 includes a pair of foldable front and rear covers integrally connected to a central back cover, and a binding fastener securely fixed to the inner face of the back cover, and is characterized by that an engaging projection is formed at the inner face of at least one of the front and rear covers for abutting engagement with the binding fastener when the front and rear covers are closed.

The file folder according to claim 2 includes a pair of foldable front and rear covers integrally connected to a central back cover, and a binding fastener securely fixed to either one of the front and rear covers at a location in the neighborhood of the adjoining back cover, and is characterized by that an engaging projection is formed at the inner face of the other of the front and rear covers for abutting engagement with the binding fastener when the front and rear covers are closed.

The engaging projection may preferably be made in the form of an elongated integral rib for supporting at least one longitudinal edge of the binding fastener.

With the improved file folder according to claim 1, the binding fastener with loose papers S-bound is securely attached to the inner face of the back cover, and when this folder is closed, at least one edge of the fastener effectively comes into abutting engagement with the. engaging projection made in the inner face of the cover. When this S-binding file folder is kept in the E-type storage mode, that particular one edge of the binding fastener in engagement with the engaging projection rests on and is supported by the projection. As a result of this abutting engagement, the weight of the S-bound papers acting on the binding fastener is carried to and supported by the cover via the engaging projection, thereby substantially eliminating the part of the load acting on the back cover. This in turn essentially eliminates the load acting on the relatively weak hinge sections between the back cover and adjoining front and rear covers. Thus, distortion of the hinge sections and the resulting reduction of their strength and durability are effectively prevented.

More specifically, with the unique arrangement of the file folder, it is possible to prevent the back cover of the folder from being warped downward under the weight of the bound papers, while at the same time avoiding the concentration of the paper weight on the weak hinge sections. In addition, when the S-binding file folders are kept in the S-type storage mode on suitable supporting shelves, it is necessary to select the distance between the adjacent shelves on the basis of the longer longitudinal size of the file folders. However, in the E-type storage of the file folder with the S-bound papers according to the invention, the shelf-to-shelf distance can be selected on the basis of the shorter lateral length or width of the folder, leading to an efficient utilization of a limited storage space. In reality, some 20% reduction in the storage space can be achieved.

With the improved file folder according to claim 2, the fastener with loose papers S-bound is fixedly provided on either one of the front and rear covers at a location near the hinge section, and when this folder is closed, the outer longitudinal edge of the binding fastener effectively comes into abutting engagement with the engaging projection made on the inner face of the other of the front and rear covers. When this file folder is kept in E-type storage, that edge of the binding fastener in engagement with the projection rests on and is supported by the projection. As a result of the abutting engagement, the weight of the papers acting on the fastener is distributed over that cover to which the binding fastener is attached as well as the abutting projection on which the fastener rests. This means that the paper load is substantially supported by both the front and rear covers, and the portion of the other cover adjacent the hinge section is essentially free of load. This in turn effectively prevents distortion at and around the hinge section and reduction of its durability. The same desirable results and advantages as in the arrangement of claim 1 are therefore achieved.

BEST MODES OF EMBODYING THE INVENTION

Figure 1:
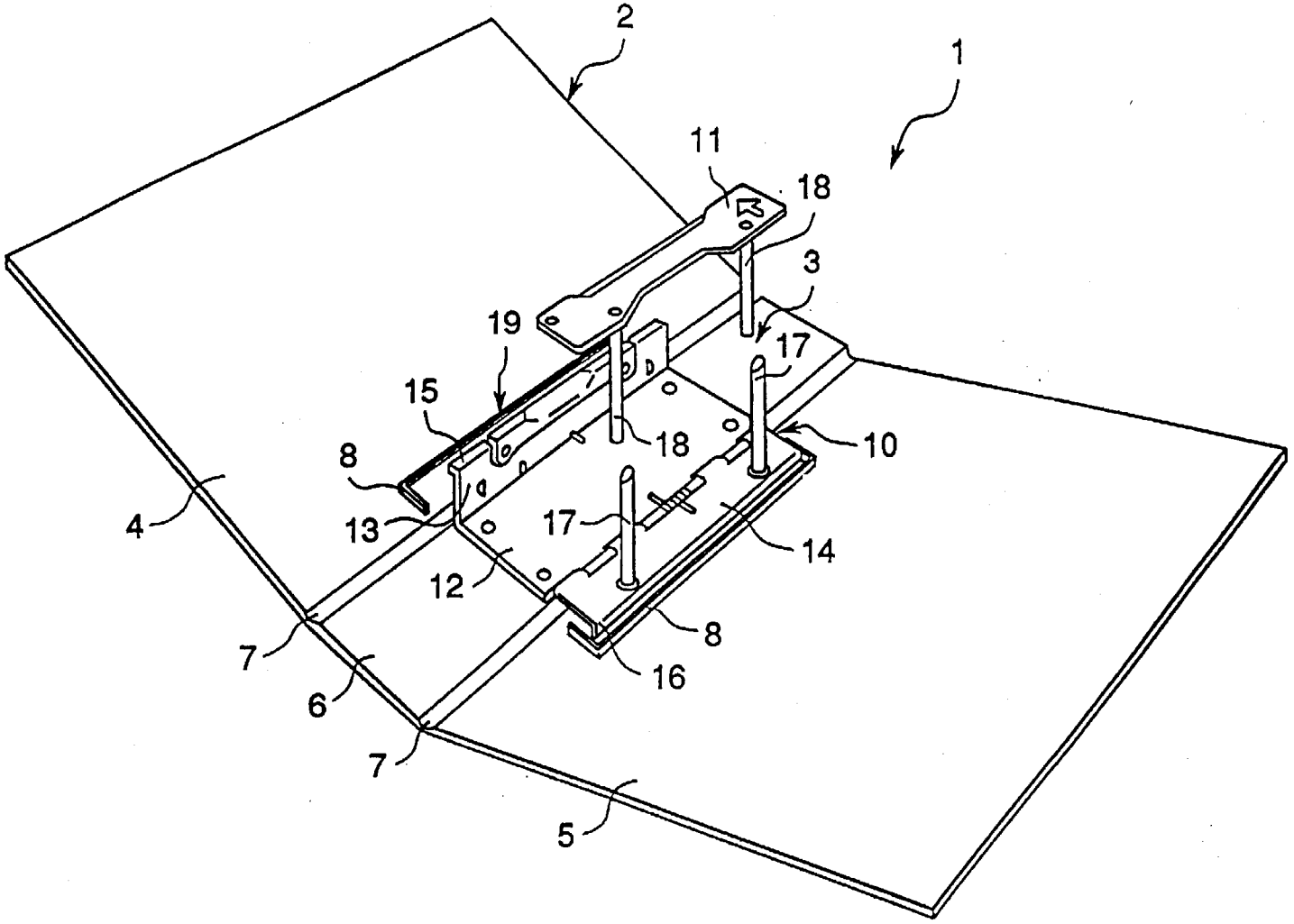
FIG. 1 is a perspective view of a first embodiment of a file folder constructed according to the invention.
Figure 2:
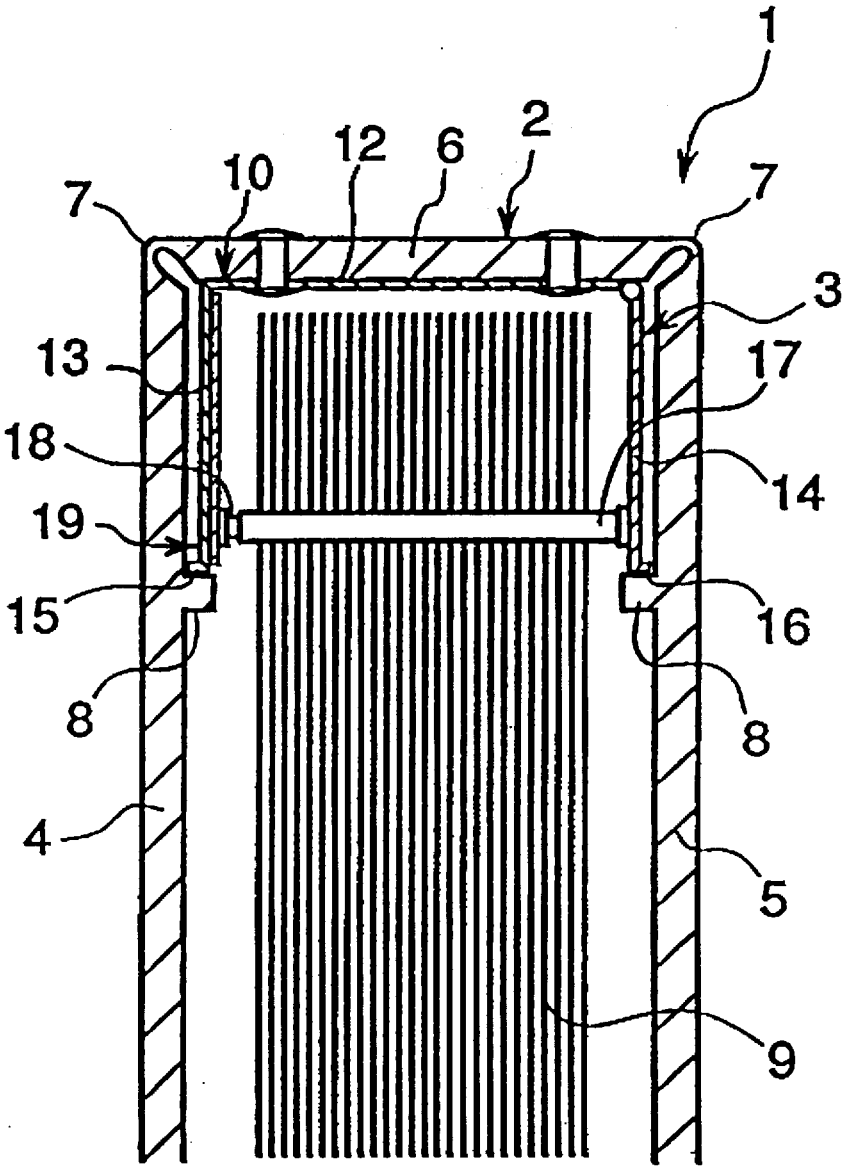
FIG. 2 is an enlarged cross-sectional view of the principal portion of the file folder shown in FIG. 1.

Referring now to FIGS. 1 and 2, there is illustrated a file folder in accordance with one preferred embodiment of the invention.

As shown in FIG. 1, the file folder 1 essentially consists of a folder body 2 and a binding fastener 3, which is securely attached to the inner face of the folder body 2. The folder body 2 is integrally formed or molded of a suitable synthetic plastic material, and has a pair of a front cover 4 and a rear cover 5 foldably connected to a back cover or spine 6 via hinge sections 7. The front and rear covers 4 and 5 have a longitudinal length larger than their width. Also, the folder body 2 is made thinner along the hinge sections 7 than the rest to facilitate opening and closing of the front and rear covers. The binding fastener 3 is riveted or otherwise fixedly attached to the inside of the back cover 6 at the longitudinal center thereof. For the purpose and function hereinafter explained in detail, there are provided, at the inner faces of the front and rear covers 4 and 5, engaging ribs 8 which come into abutting engagement with the binding fastener 3 when the file folder 1 is closed. As shown, the engaging ribs 8 generally extends longitudinally in parallel with the hinge sections 7, with both their end portions extending a short distance laterally toward the hinge sections. This gives the ribs a planar shape of a widened "U". Also, these ribs 8 are formed to have an inner longitudinal length approximately equal to the outer longitudinal length of the binding fastener 3, and a lateral width or thickness roughly three times the thickness of a metal sheet of the fastener. The engaging ribs 8 may have a height nearly equal to the width of the abutting flanges 15 and 16 of the binding fastener 3 to be described hereinafter, the height being such as not to cause the papers bound by the fastener 3 to warp excessively upward over the ribs 8 when the file folder 1 is held open for use. It should be noted that the engaging ribs 8 are formed integrally with the front and rear covers 4 and 5, and are located symmetrically with respect to the center line of the back cover 3 in positions that are most suitable for the ribs to be brought into engagement with the flange portions 15 and 16 of the fastener 3.

The binding fastener 3 includes a base member 10 riveted to the folder body 2 and a removably or detachably mounted clamp member 11 for securely holding the papers 9 in place within the binding fastener. The base member 10 is of a suitable sheet metal and comprises a flat mounting base 12, an upright fixed wall section 13 extending vertically upwardly from one longitudinal edge of the mounting base 12, and a movable wall section 14 pivotally connected to the other longitudinal edge of the base. The free end of both the fixed and movable wall sections 13 and 14 are bent outwardly to form flange portions 15 and 16. The arrangement for securely holding the papers 9 in place within the base member 10 by means of the clamp member 11 is well known in the art and may comprise, for example, elongated pipes 17 for removably mounting the clamp member 11 to the base member 10, shaft members 18 to be fittingly inserted into the pipes 17, and a locking device 19 for locking the clamp member 11 to the base member 10. Accordingly, no further reference to the arrangement is given here.

With the above-described construction of the file folder 1, when the folder body 2 is closed, the flange portions 15 and 16 of the binding fastener 3 come into direct or close abutment with the inner side faces of the engaging ribs 8. In this state, when the file folder 1 is placed on the shelf for E-type storage, i.e. placed upright on the shelf so that the back cover 6 is positioned above and oriented horizontally, the loose papers 9 secured or bound by the folder are suspended from the binding fastener 3. In this E-type storage of the file folder, as best shown in the cross-sectional view of FIG. 2, the flange portions 15 and 16 of the binding fastener rest on and are supported by the engaging ribs 8 of the folder body 2, and, with this abutting relationship, the weight or load of the whole papers 9 acting on the binding fastener 3 is distributed over the back cover 6 and the whole of the front and rear covers 4 and 5 on which the ribs 8 are formed. The load is not only distributed over several places but also both point- and surface-supported by the folder structure. In particular, the paper load is supported by those portions of the back cover 6 to which the binding fastener 3 is riveted and the front and rear covers 4 and 5 on which the engaging ribs 8 are provided. In the prior-art file folder design, when the file folder with S-bound paper is put in the E-type storage, an excessive load of the bound papers is concentrated on a few local areas of the folder structure such as the back cover 6 and the hinge sections 17, causing them to warp, be distorted or otherwise disfigured, which in turn leads to early breakdown or breakup of the folder. However, the above-described unique load distribution in the file folder of the present invention effectively eliminates all of the prior-art disadvantages, thus making possible a trouble-free E-type storage of folders with S-bound papers.

To keep the file folders with S-bound papers on the shelves in S-type storage, the vertical distance between adjacent two shelves must be selected on the basis of the longitudinal length of the folder, which is usually longer than its lateral length. However, with the unique file folders of the invention, since it is possible to keep them in the E-type storage mode, the vertical distance between the neighboring shelves may be selected on the basis of the shorter lateral length of the file folder. In other words, a shorter shelf-to-shelf distance suffices for storing the improved file folders of the invention in the E-type storing mode, which makes room for additional shelves when a plurality of shelves are to be set up in a limited space. In fact, when the file folders of the invention are stored in this manner, some 20% reduction in the storage space can be achieved.

In addition, since the engaging ribs 8 are generally formed in the widened "U"-shape, even if the file folders of the invention are kept in S-type storage, the lower ends of the flanges 15 and 16 as well as the lower ends of the fixed and movable wall sections 13 and 14 rest on and are supported by the ribs 8. Therefore, as in the case of the E-type storage, the load of the whole papers 9 bound by the fastener 3 is distributed throughout and supported by the front and rear covers 4 and 5 as well as the back cover 6 when the file folder 1 is kept in S-type storage.

Figure 3:
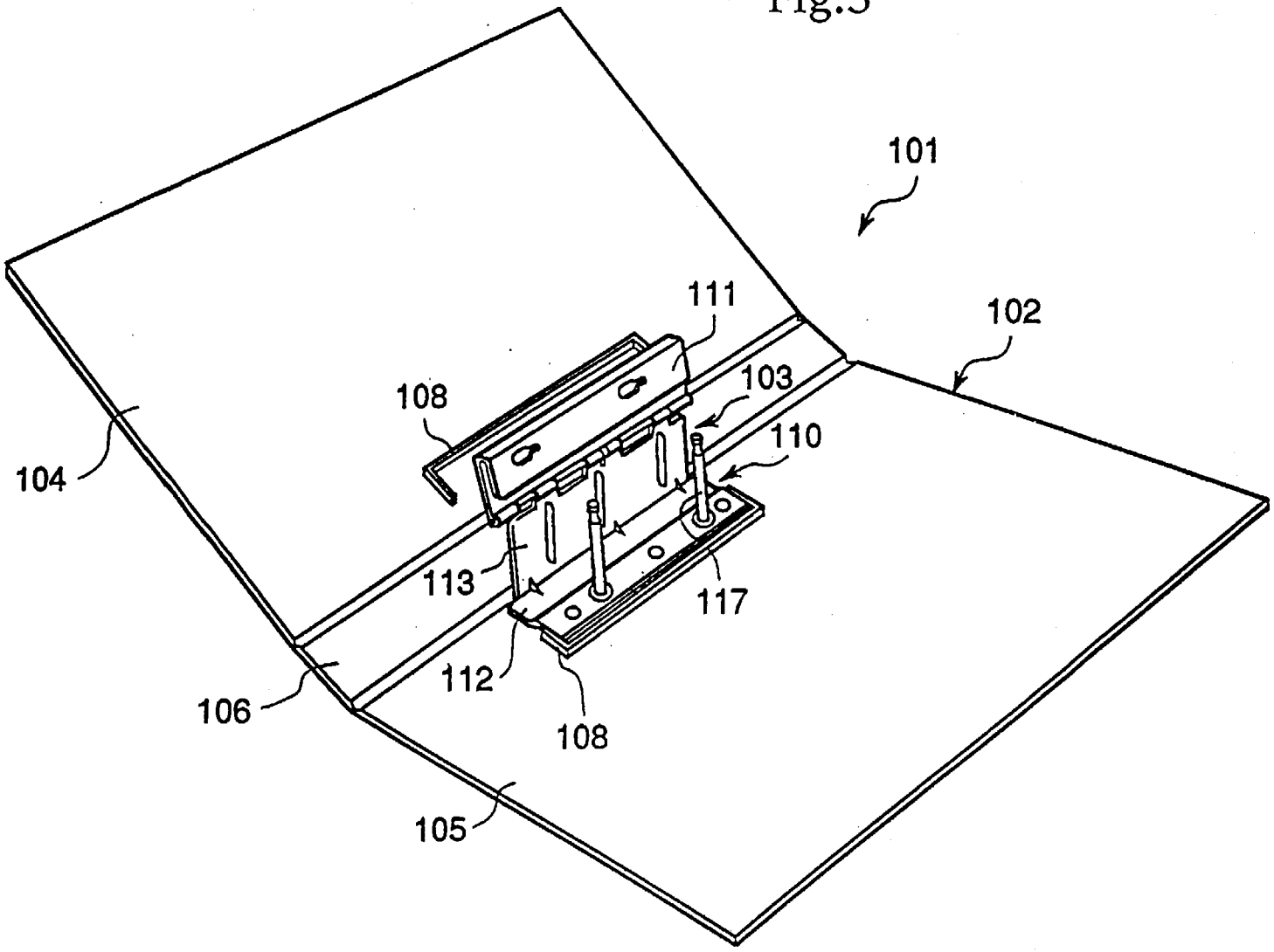
FIG. 3 is a perspective view of a second embodiment of a file folder constructed according to the invention.
Figure 4:
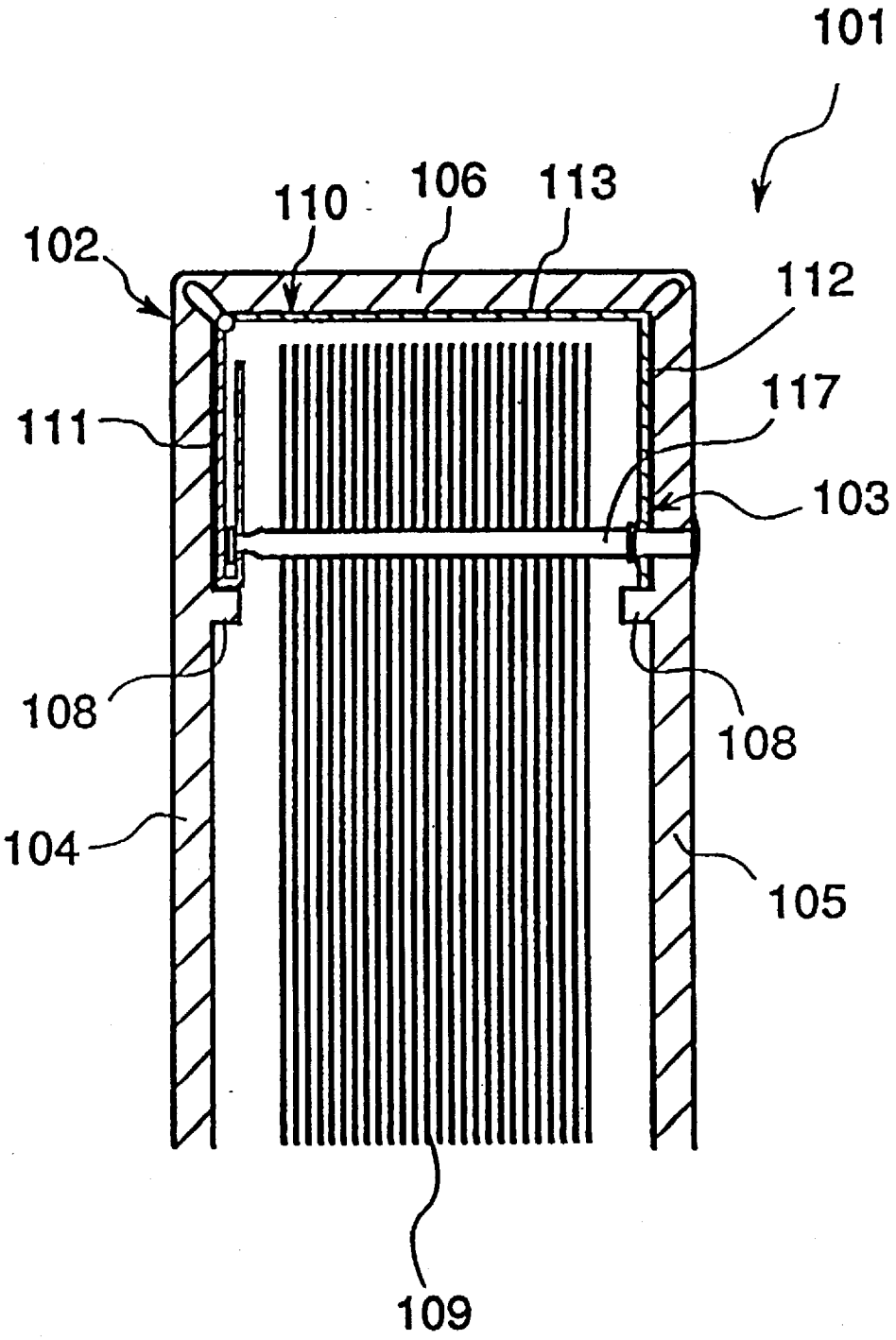
FIG. 4 is an enlarged cross-sectional view of the principal portion of the file folder shown in FIG. 3.

Now referring to FIGS. 3 and 4, there is illustrated a file folder according to another embodiment of the invention.

As shown in FIG. 3, the file folder 101 comprises a folder body 102 and a binding fastener 103 securely attached to the inside of the folder 102. The folder 102 is similar in construction to that of the first embodiment, and consists of a pair of rectangular front and rear covers 104 and 105, and a back cover 106. The binding fastener 103 is riveted or otherwise fixedly attached to the inner face of the rear cover 105 in the area adjacent to the back cover 106. On the inner faces of the front and rear covers 104 and 105 engaging ribs 108 are integrally formed so that the outer edge of the fastener 103 comes into abutting engagement with the ribs when the folder body 102 is closed. The engaging ribs 108 are in the form of a widened "U" and are made integral with the folder body 102.

The binding fastener 103 comprises a base member 110 riveted to the rear cover 105 of the folder, binding posts 117 attached to the base member 110, and a clamp member 111. The clamp member 111 is mounted for sliding and rotational movement on the free end of an upright wall section 113, which forms the upper end of the base member 110. The base member 110 is of a sheet metal and has an elongated mounting section 112 and an upright wall section 113 integrally joined to the mounting section 112 along its longitudinal edge. As in the first embodiment, the arrangement for removably connecting the clamp member 111 to the binding posts 117 is well known in the art and therefore will not be described in detail.

With the above construction of the file folder 101, when the folder body 102 having loose papers S-bound therein is closed, the binding fastener 103 secured to the rear cover 105 comes into abutting engagement with the engaging rib 108 provided on the inner face of the front cover 104. As shown in cross section in FIG. 4, if the file folder 101 is kept in E-type storage, the clamp member 111 of the binding fastener 103 rests on and is supported by the ribs 108. As a result, the whole weight or load of the bound papers 109 acting on the fastener 103 is distributed to the rear cover 105, to which the binding fastener 103 is riveted on one hand, and to the front cover 104 via the engaging rib 108, on which the binding fastener rests. The load is not only distributed over several places but also point- and surface-supported. In particular, the load of the papers 109 is carried by those portions of the rear cover 105 to which the fastener 103 is fixed and also by the front cover 104 where the rib 108 is provided.

This arrangement effectively eliminates the prior-art disadvantages encountered when the file folder 101 with S-bound papers is kept in the E-type storage manner. Moreover, it brings about the same advantages as explained with respect to the first embodiment.

The binding fastener may be of the type used in the first embodiment and may comprise a base member fixedly riveted to the cover 105 of the file body 2, and a clamp member detachably connected to the base member of the fastener.

This invention is not limited to the embodiments described in detail hereinabove. For example, the engaging ribs 8 and 108 may be formed to have only the longitudinally extending portion on which the binding fastener directly rests when the file folder is placed in E-type storage, rather than in widened U-shape with short lateral extensions at both ends. In the specific case of the engaging ribs 108, the one that is provided on the inner face of the rear cover 105 may be omitted since the binding fastener 103 is fixedly attached to the same cover by rivets or other suitable securing means.

Figure 5:
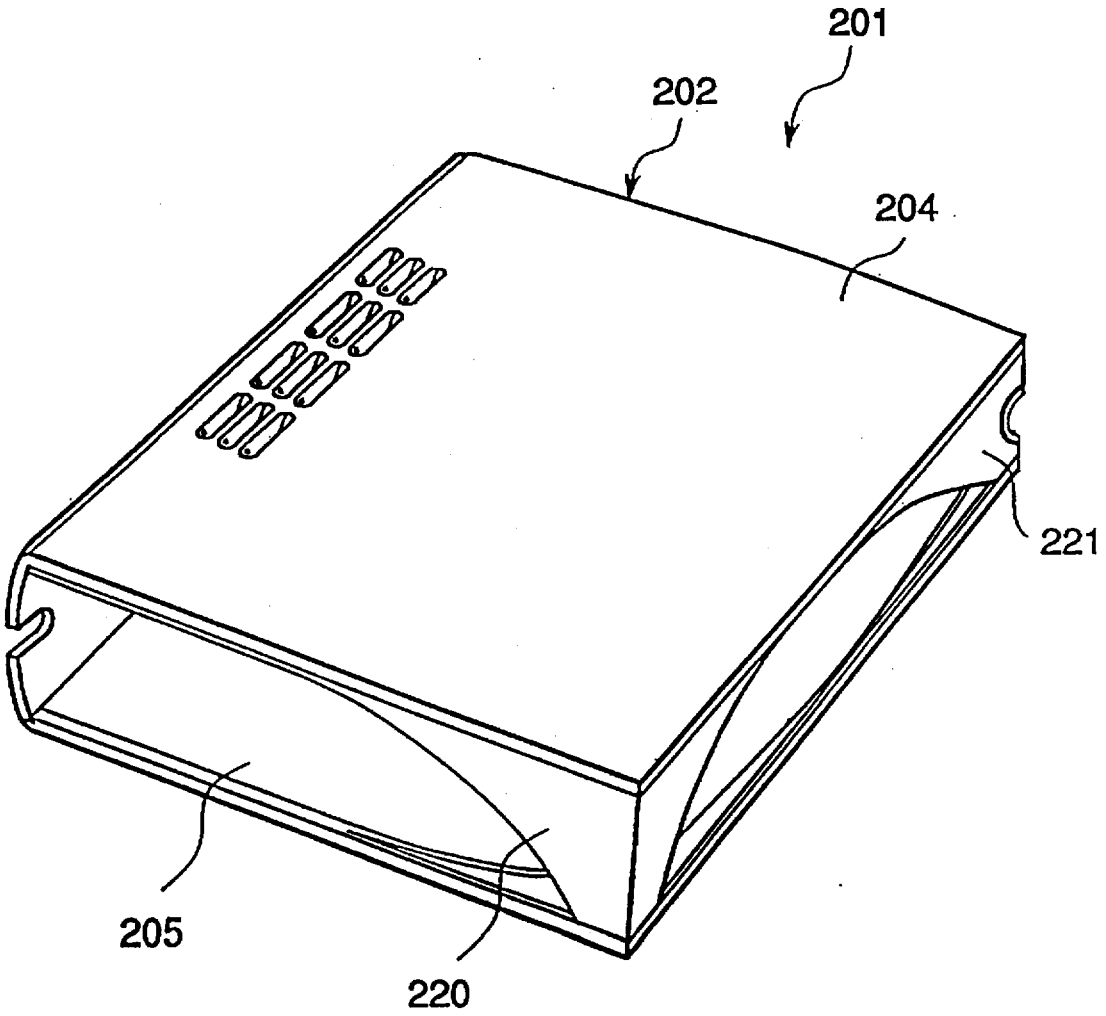
FIG. 5 is a perspective view of a modified form of a file folder constructed according to the invention.

Moreover, the file body 202 may be of the design as shown in FIG. 5, in which the cover 204 has a top wall section (not shown), a bottom wall section 220 and a front wall section 221 formed along its top, bottom and front edges, respectively, for detachable engagement with the other cover 205. In particular, since the bottom wall section 220 faces toward the user when the file folder is opened for use, a cut-out which extends close to the inner face of the cover 204 may preferably be formed in the wall section 220 so that the bottom wall section may not pose an obstacle to smooth turning over of pages. This design of the file folder greatly improves the stiffness of the file body 202, which effectively prevents it from being twisted or disfigured when the S-bound file folder 201 is kept in the E-type storage mode.

Further, the binding fastener may be a ring binding fastener. In this case, the engaging rib may be formed on the file body such that it can support the ring binding fastener in abutting contact therewith.

POSSIBLE APPLICATIONS IN INDUSTRY

As explained in detail hereinabove, the file folder of the invention is suitable for use in keeping the same in a manner such that the loose papers bound by a fastener within the folder may be suspended vertically downward from the fastener. In particular, it is suitable for use in storing the folder which securely binds loose papers along their longitudinal edges by a fastener in a manner such that the back cover of the folder is placed at the uppermost position in a horizontal orientation.

I claim:

1. A file folder comprising a pair of foldable covers, a back cover integrally connected to said foldable covers, and a binding fastener fixedly provided at the inner face of said back cover, characterized in that an engaging projection is provided at the inner face of at least one of said foldable covers for abutting with and supporting an underside of said binding fastener substantially along the length of said binding fastener when said folder is closed and placed such that said back cover is positioned horizontally and located above said binding fastener.

2. A file folder according to claim 1, wherein said engaging projection is made in the form of a rib for abutting on and supporting said binding fastener from underneath.

3. A file folder comprising a pair foldable covers, a back cover integrally connected to said foldable covers, and a binding fastener fixedly provided at the inner face of either one of said foldable covers, characterized in that an engaging projection is provided at the inner face of the other of said foldable covers for abutting with and supporting an underside of said binding fastener substantially along the length of said binding fastener when said folder is closed and placed such that said back cover is positioned horizontally and located above said binding fastener.

4. A file folder according to claim 2, wherein said engaging projection is made in the form of a rib for abutting on and supporting said binding fastener from underneath.

* * * * *